United States Patent [19]

Day

[11] Patent Number: 4,823,910

[45] Date of Patent: Apr. 25, 1989

[54] BOAT PLATFORM LADDER

[76] Inventor: Roger P. Day, P.O. Box 1065, Kemah, Tex. 77565

[21] Appl. No.: 225,768

[22] Filed: Jul. 29, 1988

[51] Int. Cl.[4] ..... B63B 29/20; E06C 5/04

[52] U.S. Cl. ..... 182/84; 182/106; 182/206; 114/362

[58] Field of Search ..... 182/84, 86, 106, 206; 114/362

[56] References Cited

U.S. PATENT DOCUMENTS

| | | | |
|---|---|---|---|
| 638,465 | 12/1899 | Karpenstein | 182/84 |
| 748,305 | 12/1903 | Snyder | 182/84 |
| 3,052,896 | 9/1962 | Beach | 114/362 |
| 3,601,220 | 8/1971 | Saucier | 182/84 |
| 4,021,071 | 5/1977 | Norman | 182/84 |
| 4,462,485 | 7/1984 | Terry | 182/84 |
| 4,719,989 | 1/1988 | Ritten | 114/362 |
| 4,724,925 | 2/1988 | Ritten | 182/86 |

*Primary Examiner*—Reinaldo P. Machado
*Attorney, Agent, or Firm*—Arnold, White & Durkee

[57] ABSTRACT

A boat platform ladder attaches at one end to the stern of a vessel and can be raised and lowered between stored and in use positions. A ladder is rotatably mounted to the opposite end of the platform. When the platform is lowered, locking mechanism fix the ladder in a perpendicular orientation relative to the platform. When the platform is raised, the ladder is unlocked so as to rotate into a parallel orientation relative to the platform.

6 Claims, 2 Drawing Sheets

Fig. 2
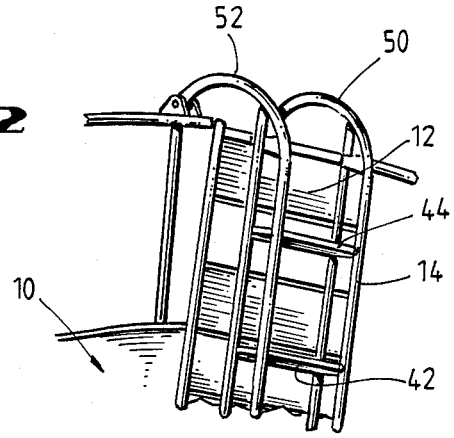
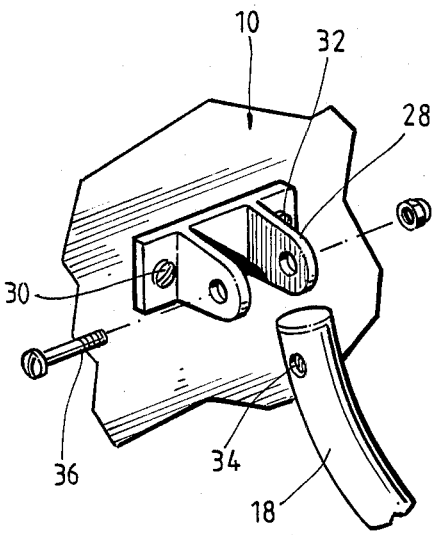
Fig. 1A
Fig. 1B
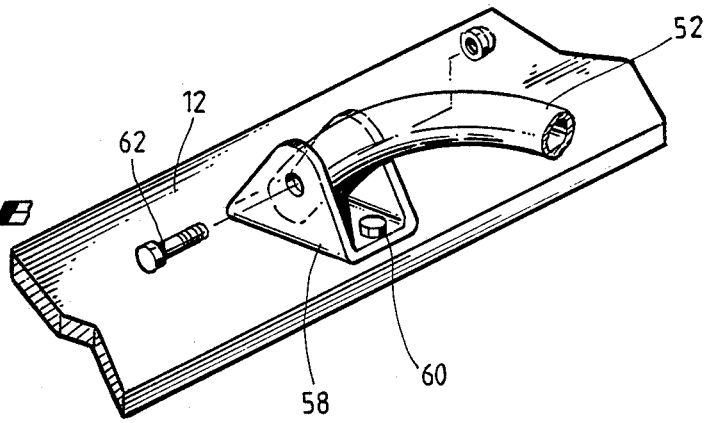

BOAT PLATFORM LADDER

BACKGROUND OF THE INVENTION

The present invention relates to boat ladders and swim platforms.

For recreational sailboats and power boats, there is the need for convenient movement of crew between the deck of the boat and the surrounding water. For example, when a vessel is anchored, there is often the desire to swim or to go ashore. Therefore, some convenient means to move crew between the boat and the surrounding water is helpful. This need has typically been satisfied by various types of ladder mechanisms.

One common form of boat ladder is the so-called "hook style ladder." This type of ladder has two parallel, hooked arms and several steps extending therebetween. The ladder is simply placed over the side of the vessel and the hooked arms are placed so as to rest on the deck surface and support the ladder steps along the side of the vessel.

Another type of ladder is the fold-down transom ladder. This type of boat ladder has a pair of parallel members having crossbars therebetween to serve as steps. At the end of each parallel member is a hinge mechanism and a fastener for permanent attachment to the stern of a vessel. When installed, the ladder can be pivoted between a vertically up position and a vertically down position.

Another device used to facilitate movement between a boat and the water is the swim platform. This device typically is a small square wood platform having a step and handrails. Swim platforms are typically detachable from the stern of a vessel.

SUMMARY OF THE INVENTION

In accordance with the present invention, a boat ladder is provided which may be permanently affixed to the stern of a vessel, either a sailboat or a power boat. The boat ladder includes a platform section to be attached at one end to the stern of a vessel between a raised, vertical position and a lowered, horizontal position. At the opposite end of the platform, a ladder section having a plurality of steps is attached for rotational movement relative to the platform. A locking mechanism is provided on the ladder section to permit the ladder to be fixed in a substantially vertical orientation relative to the platform surface when the platform is lowered. When the platform is being raised from the lowered, horizontal position to its raised, vertical position, the ladder section is unlocked and free to rotate. Raising and lowering of the platform is by a control mechanism attached between the platform and the vessel.

BRIEF DESCRIPTION OF THE DRAWINGS

The accompanying drawings illustrate the preferred embodiment invention in which:

FIG. 1A shows the details of the platform section attachment to the stern of the sailboat;

FIG. 1B is a detailed illustration of the locking mechanism to establish a fixed relationship between the ladder section and the lowered platform section;

FIG. 2 is an illustration of the boat ladder of FIG. 1 in its stored position.

DESCRIPTION OF THE PREFERRED EMBODIMENT

Figure 1:
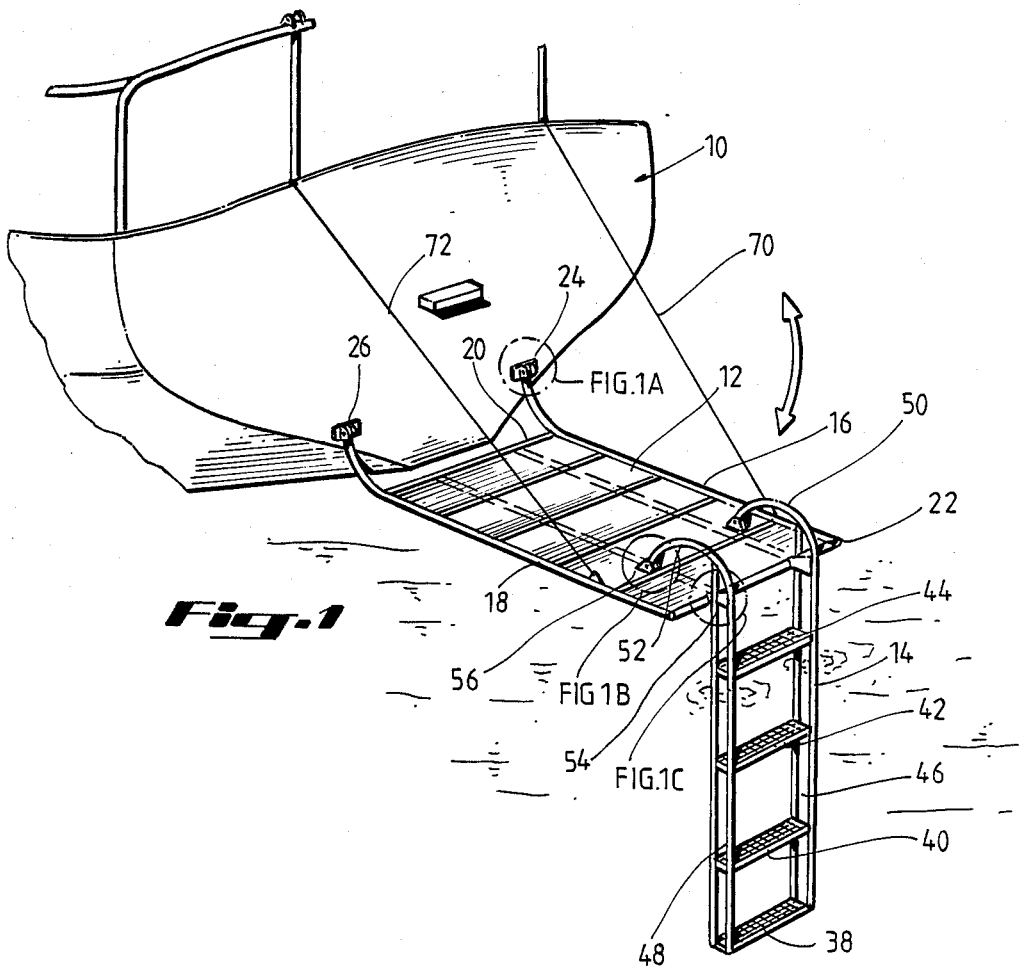
FIG. 1 is an illustration of a boat ladder in accordance with the present invention attached to the stern of a sailboat.

In FIG. 1, the stern 10 of a sailboat is shown having a boat ladder in accordance with the present invention attached thereto. The boat ladder is shown in its lowered, in use, position. In FIG. 2, the boat ladder is shown in its stored position.

The boat ladder in accordance with the present invention includes a platform section 12 and a ladder section 14. The platform section has first and second, parallel extension arms 16 and 18. The platform section 12 is generally rectangular having a first end 20 and a second end 22. The portions of the extension arms at platform end 20 are affixed to the stern 10 of the vessel by hinge mechanisms 24 and 26.

Referring to FIG. 1A, there is presented a detailed illustration of the hinge mechanisms 24 and 26. The hinge mechanism includes a clevis portion 28 which is secured by screws 30 and 32 to the stern 10. The end of the extension arm includes an opening 34 which receives a bolt fastener 36 to secure it within clevis 28.

Referring again to FIG. 1, ladder section 14 has a plurality of steps 38, 40, 42 and 44 spaced along a pair of parallel side members 46 and 48. the side members have arcuate ends 50 and 52.

Figure 1C:
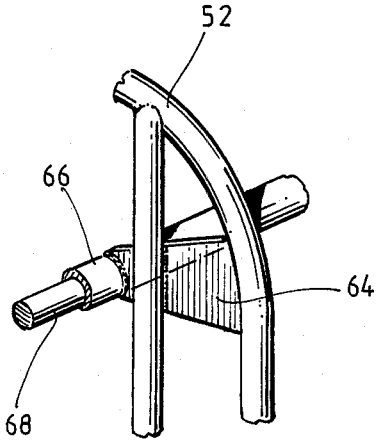
FIG. 1C is a detailed illustration of the rotation coupling between the platform section and the ladder section.

Ladder section 14 is coupled to platform section 12 by a rotational coupling 54 shown in greater detail in FIG. 1C. A locking mechanism 56 secures the arcuate ends 50 and 52 to the platform surface to fix and stabilize the ladder section in the substantially vertical orientation shown. The locking mechanism is shown in greater detail in FIG. 1B.

Referring to FIG. 1B, the locking mechanism 56 is shown to have a clevis 58 fastened to the surface of platform 12 by fastener 60. The arcuate end 52 of the ladder side member is positioned within clevis 58 and a fastening bolt 62 is inserted to secure end 52 within clevis 58.

Referring to FIG. 1C, the rotational mechanism connecting the ladder section to the platform section is shown to include a bracket member 64 attached to side member 52. Bracket 64 is attached by, for example, welding. A sleeve member 66 is attached to bracket 64. A shaft member 68 sized to be inserted within sleeve 66 is provided therethrough to form a rotational coupling. The shaft member 68 is affixed at its ends to the platform section arms 16 and 18.

The platform is supported in its lowered position by one or more guy lines 70 and 72. To raise and lower the platform section, a control mechanism is utilized. The control mechanism may suitably be an arrangement of blocks in a multi-part, purchase arrangement (i.e., block-and-tackle mechanism).

As will be appreciated, when the control mechanism is used to raise the platform and ladder from the lowered position shown in FIG. 1 to the stored position shown in FIG. 2, the platform section will pivot around the hinge mechanisms 24 and 26. When the locking mechanisms are released, ladder section 14 is free to rotate about its coupling 54. As the platform continues to be raised toward its raised position, wherein it is substantially vertical, ladder section 14 rotates to assume an orientation in which it lies substantially parallel to the platform section.

The description of the preferred embodiment has been for purposes of explanation and illustration. It will be appreciated by those skilled in the art that many modifications and changes can be made in the structure without departing from the essence of the present invention. Therefore, it is contemplated that the appended claims will cover any modifications or embodiments which fall within the scope of the invention.

What is claimed is:

1. A boat ladder to be affixed to the stern of a recreational water-borne vessel, comprising:

a platform section having a pair of parallel extension arms projecting from a first end;

a hinge mechanism carried at the end of each extension arm and adapted for attachment to the stern of a vessel, the hinge mechanism providing the platform section with pivotal movement between a raised position wherein the platform surface is substantially, vertically disposed and a lowered position wherein the platform surface is substantially, horizontally disposed;

a ladder section carried at an opposing, second end of the platform and having a plurality of steps spaced along a pair of parallel side members having arcuate ends;

a rotational coupling mechanism connecting the ladder section to the platform section and providing rotational movement of the ladder relative to the platform so that when the platform is in its lowered position, the ladder assumes a position perpendicular to the platform, and when the platform is in its raised position, the ladder assumes a position parallel to the platform;

a locking mechanism carried by each arcuate end of the ladder side members, the locking mechanisms coupling the ends of the ladder to the platform to fix the ladder in its perpendicular position;

one or more platform support means coupled between a vessel and the platform for supporting the platform in its lowered position; and control means attached to the platform for raising and lowering of the platform.

2. The boat ladder of claim 1 wherein the hinge mechanism is a pin and clevis device.

3. The boat ladder of claim 1 wherein the rotational coupling is a shaft and sleeve device in which the sleeve is connected by a bracket to the ladder section and the shaft is connected between the platform arms.

4. The boat ladder of claim 1 wherein the locking mechanism is a bolt fastener and bracket device.

5. The boat ladder of claim 1 wherein the platform support means is a guy line.

6. The boat ladder of claim 1 wherein the control means is a block and tackle device.

* * * * *